United States Patent [19]

Ebisawa et al.

[11] Patent Number: 4,578,281

[45] Date of Patent: Mar. 25, 1986

[54] METHOD OF PARTIALLY PAINTING AN ARTICLE USING LASER MASKING TECHNIQUE

[75] Inventors: Hiroo Ebisawa; Iwao Maruyama; Masao Fukuda; Shigeo Miyamoto, all of Saitama, Japan

[73] Assignee: Honda Giken Kogyo Kabushiki Kaisha, Tokyo, Japan

[21] Appl. No.: 727,403

[22] Filed: Apr. 25, 1985

[30] Foreign Application Priority Data

Apr. 27, 1984 [JP] Japan ..... 59-85992

[51] Int. Cl.[4] ..... B05D 3/06; B05D 1/32; B65B 33/00

[52] U.S. Cl. ..... 427/53.1; 427/154; 427/156; 427/259; 427/272; 427/282; 427/284; 427/289; 427/290; 427/300

[58] Field of Search ..... 427/53.1, 272, 282, 427/284, 286, 259, 154, 155, 156, 289, 290, 300

[56] References Cited

U.S. PATENT DOCUMENTS 2,408,578 10/1946 Penton ..... 427/272
4,201,799 5/1980 Stephens ..... 427/142
4,217,379 8/1980 Salvador ..... 427/272
4,358,482 11/1982 Jubelt ..... 427/259
4,468,414 8/1984 Van Vonno ..... 427/53.1

*Primary Examiner*—Thurman K. Page
*Attorney, Agent, or Firm*—Irving M. Weiner; Joseph P. Carrier; John J. Cantarella

[57] ABSTRACT

A partial painting method suitable for partially painting a workpiece or article of a complex surface shape. A surface of the workpiece is coated with strippable paint. The coated strippable paint is dried into a strippable film on the workpiece surface. A laser beam is applied to the strippable film along a prescribed cutting line so as to cut the strippable film. A portion of the strippable film corresponding to a first area of the workpiece surface to be painted is peeled off, while the remaining portion of the strippable film is left adhering on a second area of the workpiece surface to remain unpainted, and thereby masking of the workpiece is completed. The first area is then painted with a paint to form a final paint coating. The strippable paint contains powder, such as of graphite, having a substantially high light energy absorptivity, so that the strippable film can reliably be cut by the laser beam without damaging the surface of the workpiece which may be molded of synthetic resin that is relatively soft and is easily softened when heat is applied.

17 Claims, 9 Drawing Figures

METHOD OF PARTIALLY PAINTING AN ARTICLE USING LASER MASKING TECHNIQUE

BACKGROUND OF THE INVENTION

1. Field of the Invention

The present invention relates to a method of partially painting an article, and more particularly to a masking method suitable for partial painting of a product molded of synthetic resin.

2. Description of Relevant Art

Partial painting is a process of painting a portion of the surface of an article, while leaving the remainder unpainted. The partial painting process is also used to paint an object in two-tone or more colors.

Because partial painting requires that an area to be painted and an area not to be painted should be demarcated clearly from each other, the area not to be painted is ordinarily covered with masking tape or a masking plate. Where a surface to be painted is of a complex shape, however, it has been tedious and time-consuming to seal the edge of the masked area.

There are growing demands for partial painting of complicated article surfaces because more and more products of complex shape to be painted are molded of synthetic resin as the molding process is advanced. Examples of such molded products include interior components, bumpers, and other parts of automobiles.

Japanese Laid-Open Patent Publication No. 57-35970 discloses a partial painting method for partially painting a workpiece molded of synthetic resin. The disclosed painting method includes the steps of coating the surface of the workpiece with a vinyl-base strippable paint, drying the coated surface, and cutting the coating or film with a knife or a heat cutter to remove a film portion corresponding to a surface area which is to be painted, thus completing the masking of the workpiece surface. However, because most synthetic resin materials are soft and will be softened when heat is applied, the molded workpiece tends to be damaged by the knife or the heat cutter when the strippable film is cut. Where the workpiece suffers a large cut, it is readily understandable how disadvantageous such a partial painting process is. Even if the damage is small, a gap is formed between the surface of the workpiece and the strippable film covering the area not to be painted. Paint applied after the masking process is apt to seep into the gap. As a result, the paint invades the area not to be painted, and the edge of the painted area becomes dull and in misalignment with the prescribed cutting line.

Furthermore, many molded workpieces or articles have three-dimensional curved surfaces, and for this reason it is quite difficult to cut off the masking film in exact alignment with a desired cutting line according to the aforesaid cutting process. Therefore, the painted coating of the workpiece is frequently required to be corrected after the painting process.

SUMMARY OF THE INVENTION

In view of the aforesaid difficulties attendant the conventional painting method, it is an object of the present invention to provide a method of partially painting an article molded of synthetic resin or a similar object, the method including the masking step of masking a surface area not to be painted accurately along a desired cutting line in a simple procedure.

Another object of the present invention is to provide a method of partially painting an article, the method including the step of producing a sharp line which demarcates a surface area to be painted, without damaging the article surface.

According to the present invention, there is provided a method of partially painting a workpiece, comprising the steps of coating a surface of the workpiece with a strippable paint containing powder of a substantially high light energy absorptivity, drying the coated strippable paint into a strippable film on the workpiece surface, applying a laser beam to the strippable film along a prescribed cutting line so as to cut the strippable film, peeling off a portion of the strippable film corresponding to a first area of the workpiece surface to be painted, while leaving the remaining portion of the strippable film adhering on a second area of the workpiece surface not to be painted, thus completing masking the workpiece, and painting the first area with a paint to form a final paint coating.

The above and other objects, features and advantages of the present invention will become more apparent from the following detailed description when taken in conjunction with the accompanying drawings in which a preferred embodiment of the present invention is shown by way of illustrative example.

DETAILED DESCRIPTION OF PREFERRED EMBODIMENT

Figure 1:
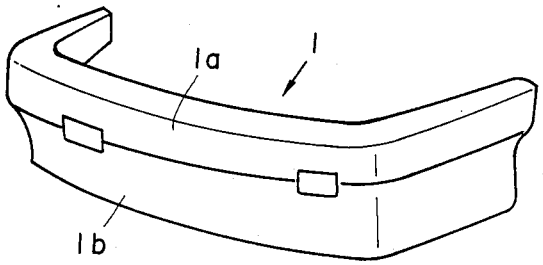
FIG. 1 is a perspective view of a workpiece to be painted by the partial painting method according to the present invention.

FIG. 1 shows a perspective view of a workpiece to be partially painted, which is an automobile bumper with a skirt. The bumper, designated generally at 1, comprises a bumper portion 1*a* and a skirt 1*b* disposed beneath and integral with the bumper portion 1*a*. According to the illustrated embodiment of the partial painting method, only the skirt 1*b* will be painted while leaving the bumper portion 1*a* unpainted, as described below.

Figure 2:
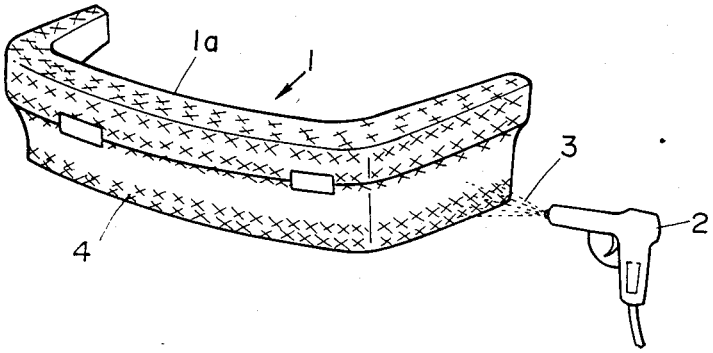
FIG. 2 shows the step of coating the workpiece with strippable paint in the partial painting method.
Figure 3:
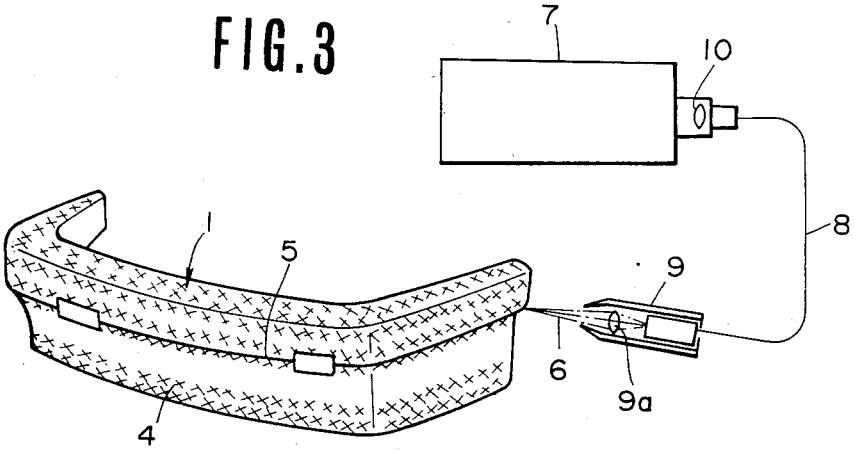
FIG. 3 shows the step of applying a laser beam to a strippable film in the partial painting method.

As shown in FIG. 2, the entire skirt 1*b* and at least the peripheral part of the bumper portion 1*a* bordering the skirt 1*b* (the entire bumper portion in the illustrated embodiment) will be coated with a strippable paint 3 sprayed by a spray gun 2. The coated paint 3 is then dired into a strippable film 4. Typically, the strippable paint 3, which may be, for example, SP 7022 manufactured by Mitsui Toatsu Chemicals, Inc. (which is an acrylic emulsion composed chiefly of an acrylic monomer, containing 50% of synthetic resin), is mixed with a powder of a substantially high light energy absorptivity such as graphite powder or carbon black. The powder of graphite or carbon black is mixed in with the strippable paint so as to increase the light absorption characteristics of the resulting strippable film 4. The strippable film 4 can, thereby, more efficiently absorb light energy, and can be reliably melted and cut by a laser beam at a later step without the danger of melting the surface of the workpiece 1. The powder for increasing the light energy absorbing efficiency is added in an amount equal to a few weight percent of the overall amount of strippable paint. In addition to powders such as carbon black or graphite, other coloring agents such as, but not exclusively, red iron oxide powder may be mixed in the strippable paint to provide the resulting strippable film with a particular color or shade. The use of red oxide iron results in a dark brown strippable film, and such film clearly distinguishes from a workpiece that is black in its original color. Red oxide iron is particularly suitable because it will not reduce the light energy aborptivity of the resulting strippable film.

Furthermore, a protecting agent such as, but not exclusively, calcium carbonate may be mixed in the strippable paint to protect the surface of the workpiece at the time when the strippable film is cut by a laser beam.

After the strippable film 4 has been formed on the surface of the workpiece 1, a laser beam 6 is applied to the film 4 along a prescribed cutting line 5 to melt and cut the illuminated film portion in a width ranging from 0.01 mm to 0.4 mm in a short period of time.

According to the illustrated embodiment, the laser light is emitted from a YAG (yttrium-aluminum-garnet) laser 7, to which is coupled one end of an optical fiber 8, the other end of which is connected to a laser beam emitter 9. The laser light generated by the YAG laser 7 is concentrated by a condenser lens 10 and led into the optical fiber 8. The laser light is then transmitted through the optical fiber 8 to the laser beam emitter 9. The laser light is focused by a condenser lens 9*a* of the laser beam emitter 9 and emitted therefrom toward the strippable film 4 as a laser beam 6.

Figure 7:
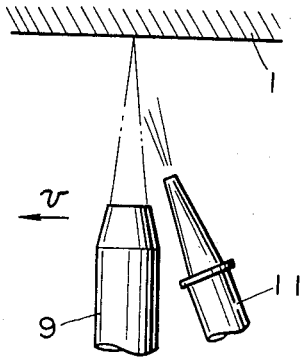
FIG. 7 is an enlarged fragmentary plan view illustrating a modification of the step of FIG. 3.

Because the width of the melted film portion is quite small, ranging from 0.01 mm to 0.4 mm as described above, the opposite surfaces across a cut-off groove tend to unite together again if the strippable film 4 is considerably thick. Where there is the danger of such reunion of the cut-off surfaces, an air nozzle 11 may be disposed adjacent the laser beam emitter 9 as shown in FIG. 7 for blowing cool air against the illuminated film portion when cutting off the same while the laser beam emitter 9 and the air nozzle 11 move in the direction of the arrow relatively to the workpiece 1.

As is well known in the art, laser sources other than the YAG laser are available, and such other laser sources include an Ar laser, an He-Ne laser, He-Cd laser, and a $CO_2$ laser, for example. The $CO_2$ laser is, however, disadvantageous in that it produces an exceedingly high output power which tends to damage the surface of the workpiece, and it is difficult to connect an optical fiber to the $CO_2$ laser. The Ar laser, the He-Ne laser, and the He-Cd laser, though easily coupled to optical fibers, have a lower power output which is insufficient to be useful in melting and cutting many strippable films according to the present invention. As a consequence, the YAG laser is most preferable for use as a laser source in the method of the present invention.

Figure 8:
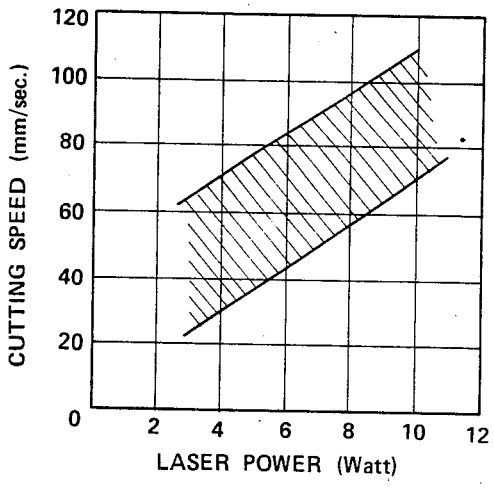
FIG. 8 is a graph showing the relationship between the cutting speed of a laser beam and the laser output power.
Figure 9:
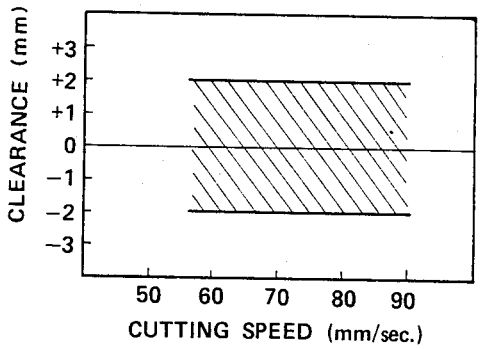
FIG. 9 is a graph showing the relationship between the cutting speed of a laser beam and the defocusing of the laser beam.

When cutting the strippable film 4 with the laser beam 6, either the laser beam emitter 9 or the workpiece 1 is moved. FIG. 8 shows the relationship between the cutting speed of such movement and the laser output power (W), with a preferred range being shown hatched. For example, when the laser output power is 7 W, the cutting speed should be in the range of from 50 mm/sec. to 90 mm/sec., and when the laser output power is 10 W, the cutting speed should range from 70 mm/sec. to 110/mm/sec. In this range, the laser beam 6 can melt and cut the strippable film 4 reliably without damaging the surface of the workpiece 1. FIG. 9 shows a preferred range, shown hatched, of clearances between the focus of the laser beam and the surface of the strippable film, with respect to the cutting speed. In melting and cutting the strippable film with the laser beam, it is preferable that the focus of the laser beam be positioned on the strippable film. However, as shown in FIG. 9, the laser beam is permitted to defocus in the depth of $\pm 2$ mm when the cutting speed is in the range of from 60 to 85 mm/sec.

Figure 4:
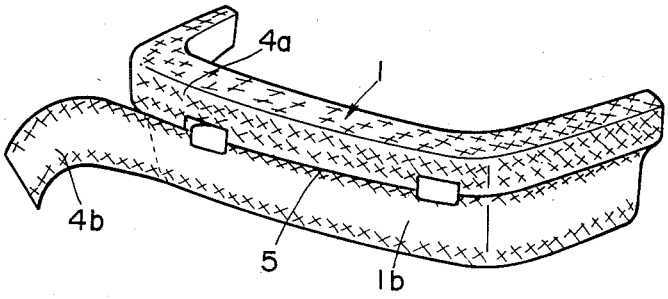
FIG. 4 shows the step of peeling off a portion of the strippable film corresponding to an area of the workpiece surface to be painted, in the partial painting method.

After the strippable film 4 on the surface of the workpiece 1 has been cut along the desired cutting line 5, the portion 4*b* of the strippable film 4 corresponding the surface area of the workpiece to be painted, i.e., the skirt 1*b*, is peeled off as illustrated in FIG. 4, leaving the portion 4*a* of the strippable film 4 adhering on the surface area of the workpiece 1 which is not to be painted. The masking process is thus completed.

Figure 5:
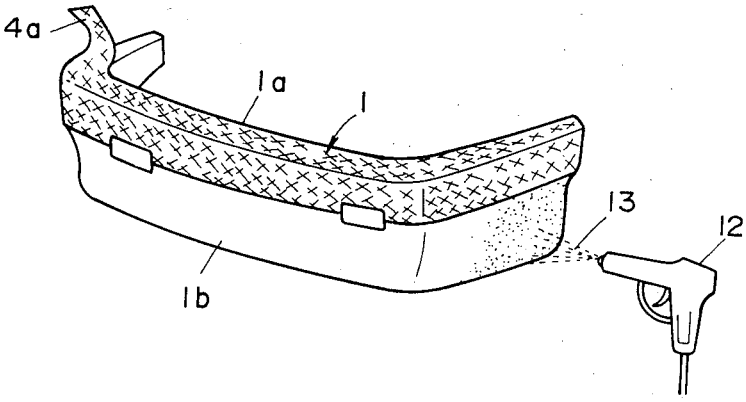
FIG. 5 shows the step of painting the workpiece with paint to form a final paint film in the partial painting method.
Figure 6:
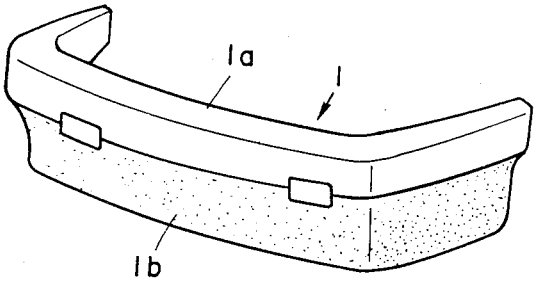
FIG. 6 is a perspective view of the workpiece after being painted by the partial painting method.

Thereafter, the skirt 1*b* is painted with paint to form a final paint coating by a spray gun 12 which jets a paint spray 13, as shown in FIG. 5. The painting may be performed in processes other than spraying. After the coated paint has been dried, the remaining strippable film 4*a* is peeled off the workpiece 1. The workpiece or bumper is now painted only on its skirt 1*b* as shown in FIG. 6.

While in the above embodiment the automobile bumper has been shown as the molded workpiece, the automobile bumper is illustrated by way of example only, and the partial painting method of the invention can be used for partially painting various other articles or workpieces. For example, the partial painting method may be employed for painting metal articles coated with synthetic resin, concrete or wood articles having a base coating of a synthetic-resin-base paint. The masking process can be carried out highly efficiently without damaging the resin coating layer or the base paint coating. For partially painting articles of highly complex shape, a known control device may be employed for controlling the position of the laser beam emitter and the focus of the laser beam for the best results.

Because the laser beam 6 can melt and cut the strippable film 4 without physical contact therewith, it will not damage the surface of the workpiece 1. The laser beam 6 can cut the strippable film 4 more exactly along the cutting line 5 and at a higher speed than the conventional cutting process. Strippable films of different thicknesses can be easily cut by varying the cutting speed or the laser output power.

Although there has been described what is at present considered to be the preferred embodiment of the present invention, it will be understood that the invention may be embodied in other specific forms without departing from the spirit or essential characteristics thereof. The present embodiment is therefore to be considered in all aspects as illustrative and not restrictive. The scope of the invention is indicated by the appended claims rather than by the foregoing description.

We claim:

1. A method of partially painting a workpiece, comprising the steps of:

coating a surface of the workpiece with strippable paint containing powder of a substantially high light energy absorptivity;

drying the coated strippable paint into a strippable film on the workpiece surface;

applying a laser beam to said strippable film along a prescribed cutting line so as to cut said strippable film;

peeling off a portion of said strippable film corresponding to a first area of the workpiece surface to be painted, while leaving the remaining portion of said strippable film adhering on a second area of the workpiece surface to remain unpainted, thereby masking said workpiece; and painting said first area with paint to form a final paint coating.

2. A method according to claim 1, wherein:

said laser beam is applied while cooling said strippable film along said cutting line with air flow.

3. A method according to claim 1, wherein:

said laser beam is produced by a laser source, a laser beam emitter, and an optical fiber interconnecting said laser source and said laser beam emitter.

4. A method according to claim 3, wherein said laser source comprises a YAG laser.

5. A method according to claim 4, wherein:

said laser beam is applied while cooling said strippable film along said cutting line with an air flow.

6. A method according to claim 1, wherein:

said powder comprises graphite powder.

7. A method according to claim 6, wherein:

said strippable paint further contains red oxide iron.

8. A method according to claim 6, wherein said laser beam is produced by a laser source, a laser beam emitter, and an optical fiber interconnecting said laser source and said laser beam emitter.

9. A method according to claim 8, wherein:

said laser source comprises a YAG laser.

10. A method according to claim 9, wherein:

said laser beam is applied while cooling said strippable film along said cutting line with an air flow.

11. A method according to claim 1, wherein:

said powder comprises carbon black.

12. A method according to claim 11, wherein:

said laser beam is produced by a laser source, a laser beam emitter, and an optical fiber interconnecting said laser source and said laser beam emitter.

13. A method according to claim 12, wherein:

said laser source comprises a YAG laser.

14. A method according to claim 13, wherein:

said laser beam is applied while cooling said strippable film along said cutting line with an air flow.

15. A method according to claim 1, wherein:

said workpiece is molded of synthetic resin.

16. A method according to claim 7, wherein:

said strippable paint further comprises a protecting agent.

17. A method according to claim 16, wherein:

said protecting agent comprises calcium carbonate.

* * * * *